United States Patent [19]

MacEwen

[11] 4,201,328

[45] May 6, 1980

[54] CONTAINER AND SIDEWALL BLANK THEREFOR

[75] Inventor: George E. MacEwen, Kansas City, Mo.

[73] Assignee: Phillips Petroleum Company, Bartlesville, Okla.

[21] Appl. No.: 8,148

[22] Filed: Jan. 31, 1979

[51] Int. Cl.[2] ..... B65D 3/04

[52] U.S. Cl. ..... 229/4.5; 93/58.4; 83/13; 83/651

[58] Field of Search ..... 229/4.5; 93/58.4; 83/13, 651

[56] References Cited

U.S. PATENT DOCUMENTS

| | | | |
|---|---|---|---|
| 1,642,174 | 9/1927 | Rudolph | 229/4.5 |
| 1,936,521 | 11/1933 | Oliver et al. | 93/49 M |
| 2,038,661 | 4/1936 | Kronquest | 220/75 |
| 2,226,670 | 12/1940 | Pratt et al. | 312/214 |
| 3,411,690 | 11/1968 | Walsh et al. | 229/4.5 |
| 3,944,126 | 3/1976 | Richards | 229/4.5 |
| 4,072,226 | 2/1978 | Richards et al. | 198/345 |
| 4,157,147 | 6/1979 | DeForest | 229/4.5 X |

*Primary Examiner*—Davis T. Moorhead

[57] ABSTRACT

A convolute sidewall container of paperboard or the like having an outwardly rolled top rim and a closed bottom, the container comprising a one-piece sidewall blank of generally rectangular shape having top and bottom edges, first and second side edges, and four corner edges. The four corner edges are so configured as to facilitate production blanking operations and the formation of the outwardly rolled top rim without bulges, splits, tails or torn places in and around the overlapped portion of the rolled top rim.

38 Claims, 6 Drawing Figures

CONTAINER AND SIDEWALL BLANK THEREFOR

The invention relates generally to the forming of containers. In one aspect the invention relates to an improved container structure. In another aspect the invention relates to an improved sidewall configuration for the container structure.

The use of convolute sidewall paperboard or thermoplastic-coated paperboard containers is widely accepted for a large variety of packaging requirements. One particularly useful container configuration of this type employs an outwardly rolled top rim for accepting a closure having a generally planar surface with an annular flange or skirt depending therefrom to engage the rolled container top rim.

In the formation of such convolute sidewall containers, the opposite side edges of the sidewall blank are overlapped and sealed together in such overlapped condition by suitable means such as thermoplastic bonding as described in detail in U.S. Pat. No. 4,072,226 issued to Richards et al. In order to accommodate the overlapped, double thickness of the blank during the formation of the rolled rim to achieve a rolled rim of substantially constant radius of curvature through the full diameter of the container top and maintain the substantially circular opening of the container top, it is customary to employ a sidewall blank wherein a portion of the sidewall material from either or both of the corner edges defined by the intersection of the sidewall top edge and the previously mentioned opposite sidewall side edges has been removed therefrom.

It has recently become advantageous to form such containers with relatively small diameter container tops, e.g. from about a 2-inch (5.08 cm) diameter to about a 3.5-inch (8.89 cm) diameter. When forming the outwardly rolled rim about the container top at these relatively small diameters, it has been found that the conventional sidewall blank corner edge configurations, which appear to form satisfactory rolled rims for larger diameter containers, achieve progressively less satisfactory results as the container diameters are decreased to the smaller diameters mentioned above. Such undesirable rolled rims are characterized by bulges, splits and tails or torn places in the sidewall blank in and around the overlapped portion of the rolled rim.

It has also been found that various sidewall blank corner edge configurations are difficult to cut from a sheet or web of sheet material such as paperboard and the like due to the existence of relatively sharp points on the cut-out portions of the sheet material defined by the corner edges of adjacent sidewall blanks in a conventional production blanking pattern. Such points are difficult to cut cleanly during production blanking operations and often break off when being stripped from production blanking dies. The unstripped points build up in the dies and wedge the knife blades apart thereby resulting in the production of defective sidewall blanks and necessitating production shutdown and die repair.

Accordingly, it is an object of the invention to provide a convolute sidewall container having a smoothly rolled top rim devoid of bulges, splits, tails or tears in and around the overlapped portions of the convolute sidewall. Another object of the invention is to provide an improved sidewall blank configuration which results in a smoothly rolled top rim in a convolute sidewall container. Yet another object of the invention is to provide an improved sidewall blank configuration which can be efficiently cut from a web or sheet of sheet material without the generation of sharp points in the cut-out portions between adjacent sidewall blanks.

In accordance with the invention there is provided a tubular container comprising a convolute sidewall defining a substantially circular container top having an outwardly rolled top rim formed thereon and a substantially circular container bottom. The container further includes bottom closure means sealingly secured to the circular container bottom of the sidewall for closing the circular container bottom. The convolute sidewall comprises a sidewall blank of sheet material having a top edge, a bottom edge, a first side edge, and a second side edge. A first corner edge extends between the top edge and the first side edge and is generally straight through at least a portion of its full length and intersects the top edge at a first included obtuse angle and intersects the first side edge at a second included obtuse angle. A second corner edge extends between the top edge and the second side edge and comprises a first convex arcuate edge portion which tangentially intersects the top edge, and a first additional edge portion which intersects the second side edge at an angle in the range from about 45 degrees to about 135 degrees. The first convex arcuate edge portion and the first additional edge portion mutually intersect.

In one form, the sidewall blank of the invention includes a third corner edge extending between the bottom edge and the first side edge which comprises a second additional edge portion intersecting the bottom edge at an angle in the range from about 45 degrees to about 135 degrees, a third additional edge portion intersecting the first side edge at an angle in the range from about 45 degrees to about 135 degrees, and a second convex arcuate edge portion extending between the second additional edge portion and the third additional edge portion and intersecting each of the second and third additional edge portions; and a fourth corner edge extending between the bottom edge and the second side edge, the fourth corner edge comprising a fourth additional edge portion intersecting the bottom edge at an angle in the range from about 45 degrees to about 135 degrees and a generally straight edge portion having first and second ends and extending between the fourth additional edge portion and the second side edge, the first end of the generally straight edge portion intersecting the fourth additional edge portion and the second end of the generally straight edge portion intersecting the second side edge at a third included obtuse angle.

Other objects and advantages of the invention will be apparent from the specification and claims to the invention when read in conjunction with the drawings in which:

Figure 1:
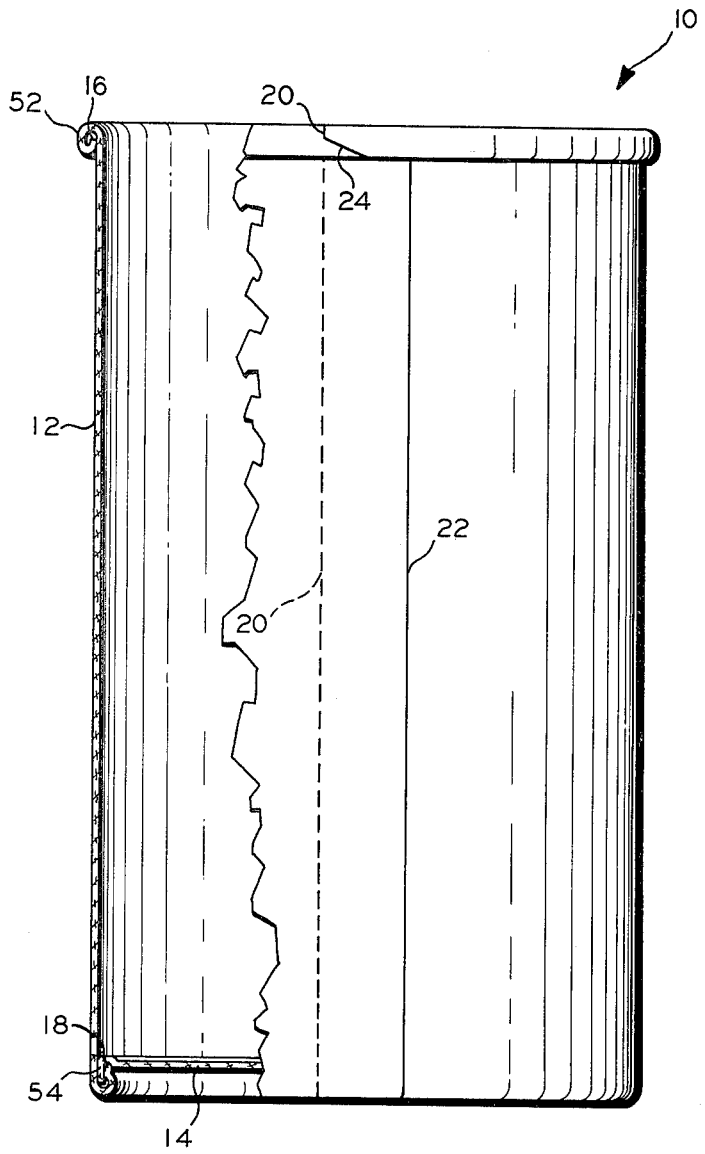
FIG. 1 is a side elevation view of a container constructed in accordance with the present invention in which a portion of the container is broken away to illustrate details of construction.
Figure 2:
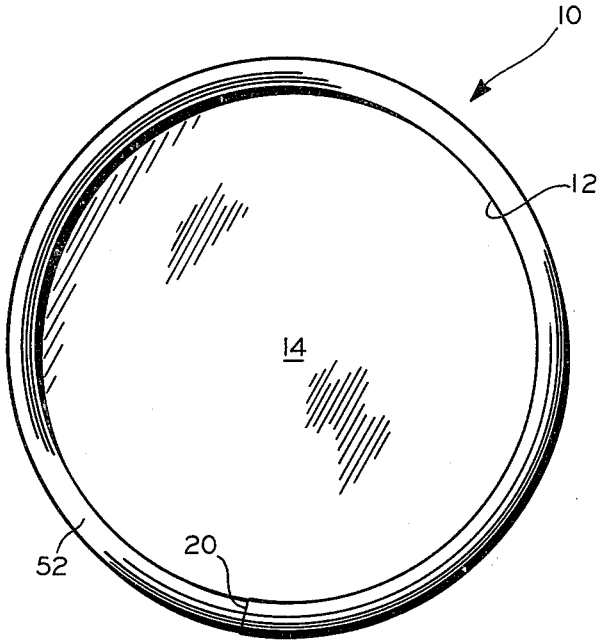
FIG. 2 is a top plan view of the container of FIG. 1.
Figure 3:
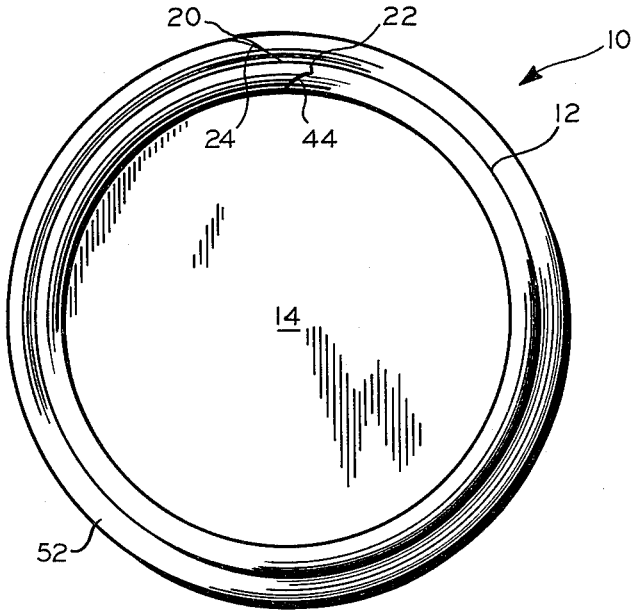
FIG. 3 is a bottom plan view of the container of FIG. 1.
Figure 4:
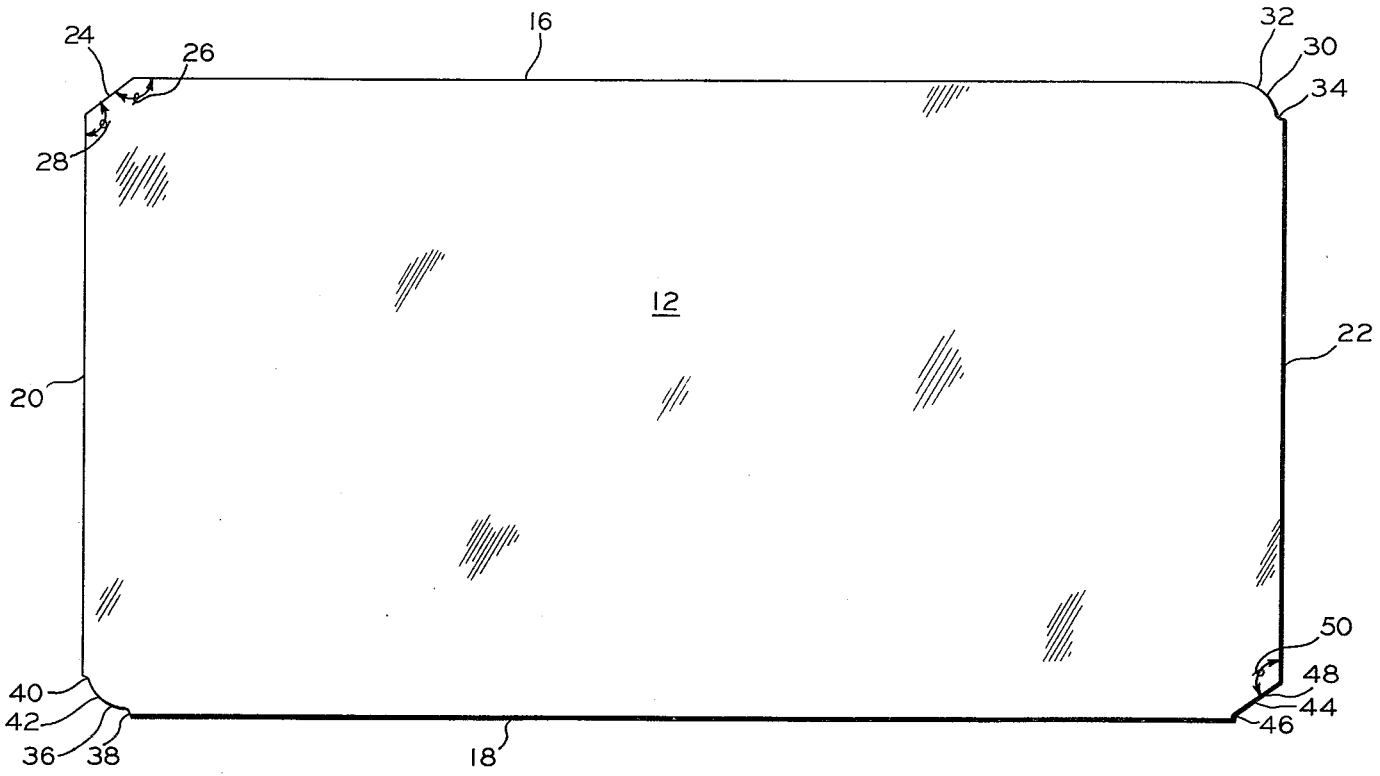
FIG. 4 is a plan view of a container sidewall blank constructed in accordance with the present invention.

Referring now to the drawings and to FIGS. 1, 2 and 3 in particular, there is illustrated therein a container constructed in accordance with the present invention and generally designated by the reference character 10. The container 10 comprises a one-piece sidewall 12 and a generally circular bottom member 14. The sidewall 12 and the bottom member 14 are each formed of a suitable sheet material which can be readily formed into the configurations illustrated in the drawings. A suitable sheet material for this purpose is paperboard which is preferably provided with a film coating of a suitable thermoplastic on either or both sides thereof. In a preferred embodiment, the sheet material is in the form of a solid bleached kraft paperboard sold by International Paper Co. having a thickness of about 0.017 inch (0.432 mm) and coated on each side with a low density polyethylene film coating of about 0.00075 inch (0.019 mm).

The sidewall 12 is constructed of a one-piece sidewall blank having a top edge 16, a bottom edge 18, a first side edge 20 and a second side edge 22. A first corner edge 24 extends between the top edge 16 and the first side edge 20. The first corner edge 24 is generally straight throughout at least a portion of its full length, and in a preferred embodiment is substantially straight throughout its full length and intersects the top edge 16 at a first included obtuse angle 26 in the range from about 114 to about 144 degrees and intersects the first side edge 20 at a second included obtuse angle 28 in the range from about 126 to about 156 degrees.

A second corner edge 30 extends between the top edge 16 and the second side edge 22. The second corner edge 30 comprises a first convex arcuate edge portion 32 having a radius of curvature generally in the range from about 0.218 inch (5.5 mm) to about 0.282 inch (7.2 mm) and tangentially intersecting the top edge 16. The second corner edge 30 further comprises a first additional or concave arcuate edge portion 34 having a radius of curvature generally in the range from about 0.046 inch (1.1 mm) to about 0.079 inch (2.0 mm) and intersecting the second side edge 22 at an angle generally in the range from about 45 degrees to about 135 degrees, and in a preferred embodiment at an angle of about 90 degrees. The first convex arcuate edge portion 32 and the first concave arcuate edge portion 34 intersect in mutual tangential relation.

A third corner edge 36 extends between the bottom edge 18 and the first side edge 20. The third corner edge 36 comprises a second additional or concave arcuate edge portion 38 having a radius of curvature generally in the range from about 0.046 inch (1.1 mm) to about 0.079 inch (2.0 mm) and intersecting the bottom edge 18 at an angle generally in the range from about 45 degrees to about 135 degrees, and in a preferred embodiment at an angle of about 90 degrees. The third corner edge 36 further includes a third additional or concave arcuate edge portion 40 having a radius of curvature generally in the range from about 0.046 inch (1.1 mm) to about 0.079 inch (2.0 mm) and intersecting the first side edge 20 at an angle generally in the range from about 45 degrees to about 135 degrees, and in a preferred embodiment at an angle of about 90 degrees. The third corner edge 36 also includes a second convex arcuate edge portion 42 having a radius of curvature generally in the range from about 0.218 inch (5.5 mm) to about 0.282 (7.2 mm) and extending between said second additional or concave arcuate edge portion 38 and said third additional or concave arcuate edge portion 40 and intersecting each of said second and third additional or concave arcuate edge portions 38 and 40 in mutual tangential relation.

A fourth corner edge 44 extends between the bottom edge 18 and the second side edge 22. The fourth corner edge 44 comprises a fourth additional or concave arcuate edge portion 46 having a radius of curvature generally in the range from about 0.046 inch (1.1 mm) to about 0.079 inch (2.0 mm) and intersecting the bottom edge 18 at an angle generally in the range from about 45 degrees to about 135 degrees, and in a preferred embodiment at an angle of about 90 degrees. The fourth corner edge 44 further includes a generally straight edge portion 48 having first and second ends and extending between the fourth additional or concave arcuate edge portion 46 and the second side edge 22, with the first end of the generally straight edge portion 48 tangentially intersecting the fourth additional or concave arcuate edge portion 46 and with the second end of the generally straight edge portion 48 intersecting the second side edge 22 at a third included obtuse angle 50 in the range from about 110 to about 140 degrees. The edge portion 48 is generally straight throughout at least a portion of its full length, and in a preferred embodiment is substantially straight throughout its full length.

The container 10 is characterized by an outwardly rolled top rim 52 formed on the sidewall 12 adjacent and along the top edge 16 and having a bead radius generally in the range from about 0.03 inch (0.76 mm) to about 0.1 inch (2.6 mm). Method and apparatus for forming such a top rim is disclosed in detail in U.S. Pat. No. 4,072,226, issued to Richards et al and mentioned above. In a preferred embodiment of the container 10, employing the previously mentioned paperboard sheet material, the top rim 52 has a nominal bead radius of about 0.05 inch (1.3 mm). The bottom edge 18 of the sidewall 12 is rolled inwardly around and is sealingly engaged with a depending annular flange or skirt 54 of the generally circular bottom member 14. As best shown in FIG. 1, the second side edge 22 overlaps the first side edge 20 a sufficient distance to achieve a suitable seal or seam between the overlapping surfaces adjacent the side edges and form a convolute tubular sidewall with the second side edge 22 on the outside and the first side edge 20 on the inside of the convolute tubular sidewall. In a preferred embodiment, the amount of overlap is generally in the range from about 0.25 inch (6.3 mm) to about 0.5 inch (12.7 mm), or more preferably about 0.375 inch (9.53 mm).

In a preferred embodiment, the first, second, third and fourth additional or concave arcuate edge portions 34, 38, 40 and 46 have substantially equal radii of curvature. The radius of curvature of each of these concave arcuate edge portions is preferably about 0.063 inch (1.6 mm). Similarly, the radii of curvature of the first and second convex arcuate edge portions 32 and 42 are also preferably substantially equal and are preferably about 0.250 inch (6.35 mm).

The first corner edge 24 intersects the top edge 16 and first side edge 20 at points and the second corner edge 30 intersects the top edge 16 and second side edge 22 at points which result in the formation of a rolled top rim 52 on the container 10 which is smoothly rolled through the entire length of the rim including the overlapped portion thereof, with the overlapped portion thereof being substantially free of bulges, tails, splits or tears therein or adjacent thereto.

In a preferred configuration of the first corner edge 24, the first corner edge generally intersects the top edge 16 at a distance of about one half the amount of overlap of the first and second side edges or about 0.313 inch (7.95 mm) measured horizontally from the line of the vertical first side edge 20 for an overlap of about 0.375 inch (9.53 mm), and generally intersects the first side edge 20 at a distance of about five times the nominal bead radius of the top rim 52, or about 0.250 inch (6.35 mm) measured vertically downwardly from the horizontal line of the top edge 16. The first included obtuse angle 26 is about 129 degrees and the second included obtuse angle 28 is about 141 degrees.

In a preferred embodiment of the second corner edge 30, the first additional or concave arcuate edge portion 34 intersects the second side edge 22 at a distance of about five times the nominal bead radius of the top rim 52, or about 0.250 inch (6.35 mm) measured vertically downwardly from the horizontal line of the top edge 16. The first convex arcuate edge portion 32 generally tangentially intersects the top edge 16 at a distance about one half the amount of overlap of the first and second side edges or about 0.313 inch (7.95 mm) measured horizontally from the line of the vertical second side edge for an overlap of about 0.375 inch (9.53 mm).

In a preferred configuration of the third corner edge 36, the second additional concave arcuate edge portion 38 intersects the bottom edge 18 at a distance of about 0.313 inch (7.95 mm) measured horizontally from the vertical line of the first side edge 20, and the third additional or concave arcuate edge portion 40 intersects the first side edge 20 at a distance of about 0.250 inch (6.35 mm) measured vertically upwardly from the horizontal line of the bottom edge 18.

In a preferred configuration of the fourth corner edge 44, the fourth additional or concave arcuate edge portion 46 intersects the bottom edge 18 at a distance of about 0.313 inch (7.95 mm) measured horizontally from the vertical line of the second side edge 22, and the straight edge portion 48 intersects the second side edge 22 at a point about 0.250 inch (6.35 mm) measured vertically upwardly from the horizontal line of the bottom edge 18. The third included obtuse angle 50 is preferably about 125 degrees.

It will be seen from the foregoing preferred dimensions that the radii of curvature of the first and second convex arcuate edge portions 32 and 42 are not only substantially equal but are also substantially equal to the vertical distance between the horizontal line of the top edge 16 and the point of intersection of the second corner edge 30 with the side edge 22, as well as the vertical distance between the horizontal line of the bottom edge 18 and the point of intersection between the third corner edge 36 and the first side edge 20. It will also be noted that the preferred radii of curvature of the first and second convex arcuate edge portions 32 and 42 are each about five times the preferred bead radius of the top rim 52. Similarly, the preferred radii of curvature of the first and second convex arcuate edge portions 32 and 42 are each about four times the preferred radius of curvature of each of the first, second, third and fourth concave arcuate edge portions 34, 38, 40 and 46.

While a preferred thickness of paperboard has been disclosed herein, it will be understood that any suitable thickness of relatively flexible sheet material suitable for use in the construction of the container 10 can be employed. A sheet thickness in the range from about 0.012 inch (0.30 mm) to about 0.022 inch (0.56 mm) can be generally utilized.

It will also be noted that in a preferred embodiment of the container 10, the radius of each of the first, second, third and fourth concave arcuate edge portions 34, 38, 40 and 46 is approximately equal to about 4 times the preferred thickness of the sheet material, 0.017 inch (0.432 mm), and the radius of each of the first and second convex arcuate edge portions 32 and 42 is approximately equal to about 15 times the preferred thickness of the sheet material.

Figure 5:
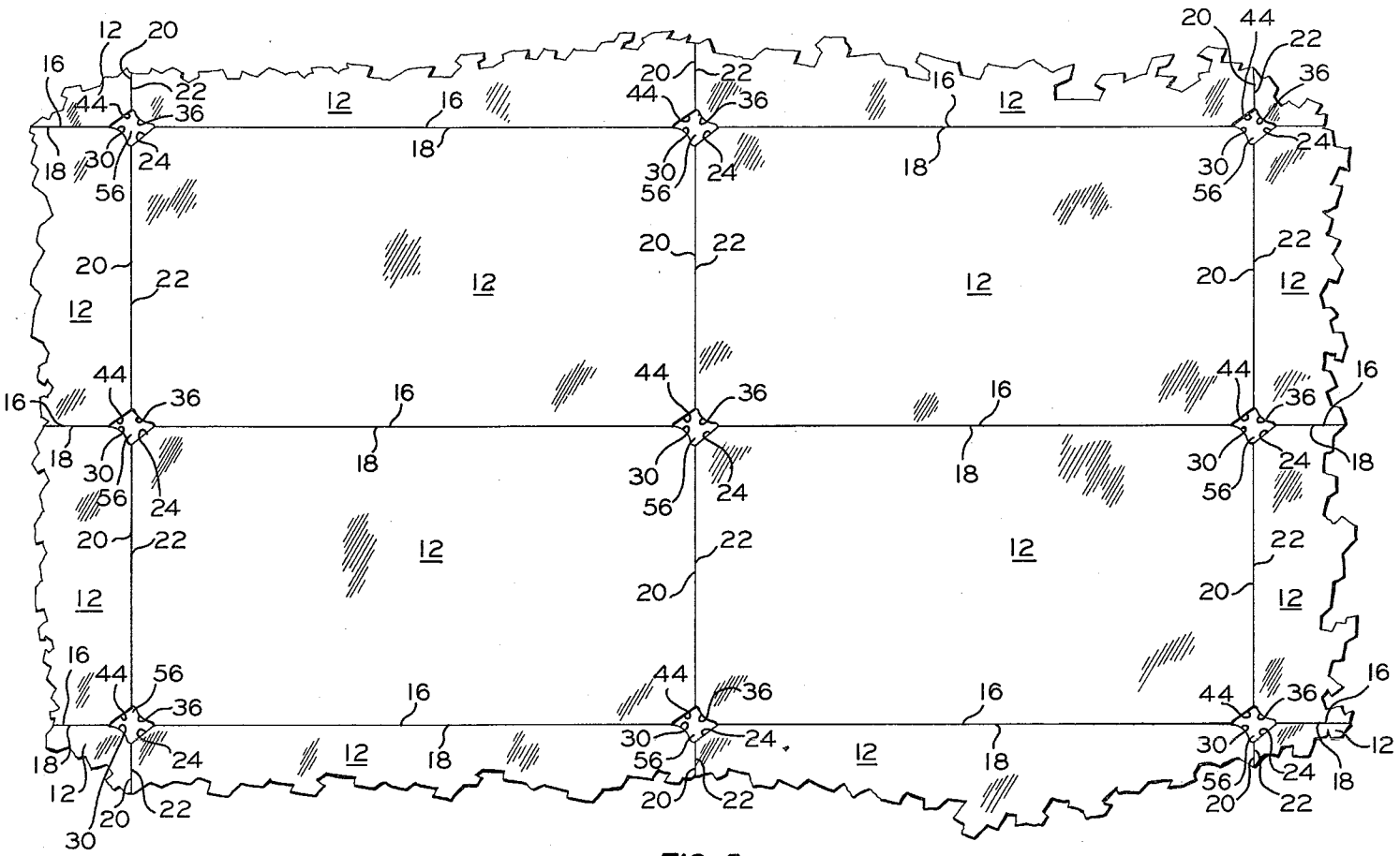
FIG. 5 is a plan view of a portion of a web of sheet material illustrating a sidewall blanking pattern in accordance with the present invention.
Figure 6:
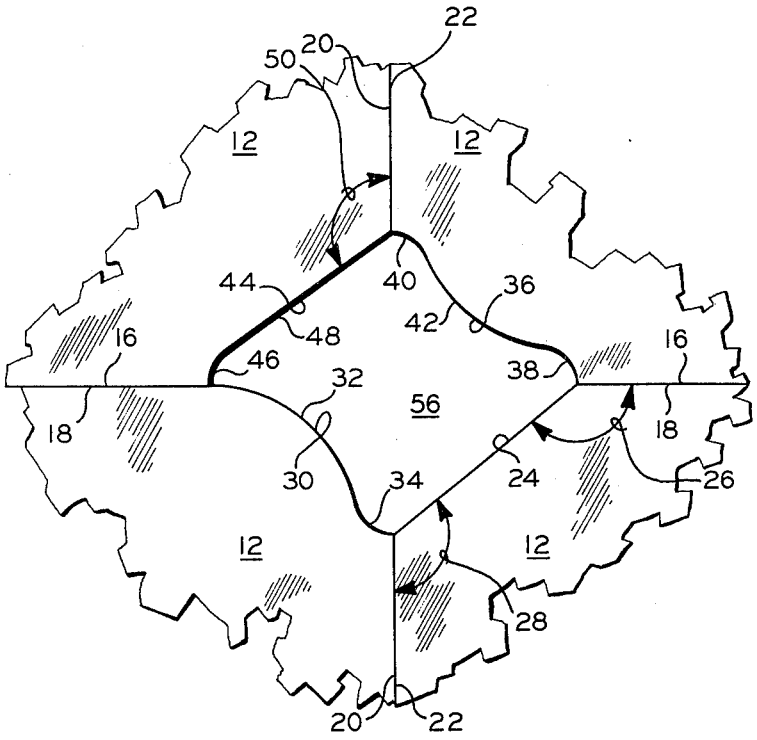
FIG. 6 is an enlarged portion of the web of FIG. 5 more clearly illustrating the cut-out portion between adjacent corner portions of adjacent sidewall blanks.

Referring now to FIGS. 5 and 6, there is illustrated therein a production blanking die pattern for cutting a plurality of blanks for the one-piece sidewall 12 from a sheet or web of sheet material. In the blanking die pattern so illustrated, it will be seen that the adjacent corner portions 24, 30, 36 and 44 of adjacent blanks define a cut-out portion of the sheet material which area is indicated by the reference character 56. As best shown in FIG. 6, it will be seen that the area of the cut-out portion 56 is completely devoid of any sharp points having an included angle of less than about 90 degrees which, if present, could cause difficulty in the separation of the cut-out portion from the knife blades of the production dies. Failure to achieve such clean separation of the cut-out portion from the production dies can result in the production of defective blanks and defective containers as well as necessitating production shutdowns for die repairs. It will be readily apparent that the smoothly curved and straight surfaces of the corner edges 24, 30, 36 and 44 not only improve the efficiency of cutting and removing the cut-out portion, but also greatly simplify the manufacture and maintenance of the cutting die necessary for the performance of the production blanking process on a web or sheet of sheet material.

In a preferred embodiment the blanking die pattern illustrated in FIGS. 5 and 6 is employed with a conventional punch-type or rolling-type blanking press or printer blanker. The desired die pattern design is transferred by suitable means to the blanking press die board, which is ordinarily formed of plywood, and grooves or slots are formed in the die board conforming to the pattern design. Steel ruling die knife blades, which conform to the desired die pattern design are then fixedly secured by suitable means in the corresponding grooves or slots to form a steel rule die assembly. This assembly is then mounted in a suitable blanking press of the punch type.

In operation of the punch-type blanking press, a continuous web of sheet material is fed into the blanking press between the die assembly and a flat platen made of aluminum or other suitable material where blanks are cut from the web by forcing the blades of the die assembly through the web against the platen. When the die assembly is withdrawn from contact with the web, the cut web is conveyed from the blanking press to a conventional stripper where edge scrap and the cutout portions between adjacent corners of the blanks are stripped from the web by means of picker fingers. It is during this withdrawal of the die assembly from contact with the web that the previously mentioned sharp points, which are present on the cut-out portions associated with other container sidewall blank configurations, can break off and accumulate between die knife blades and thereby force the knife blades apart thus necessitating production shutdown and die repair.

While the corner configurations of the sidewall blank of the instant invention have been illustrated in conjunction with the fabrication of cylindrically shaped, tubular convolute sidewall containers, it will be understood that these corner configurations are equally applicable to the fabrication of frusto-conically shaped, nesting type, tubular convolute sidewall containers having rolled top rims. The sidewall blanks used in the fabrication of cylindrically shaped tubular convolute sidewall containers are characterized by substantially parallel first and second side edges 20 and 22, while sidewall blanks used in the fabrication of frusto-conically shaped, nesting type, tubular convolute sidewall containers are characterized by first and second side edges which diverge as they extend from the bottom edge toward the top edge, the top edge defines a generally convex arc, and the bottom edge defines a generally concave arc.

While each aspect of the invention has been described in conjunction with a preferred embodiment thereof, it is to be understood that equivalent embodiments and modifications by those skilled in the art are within the scope of the invention.

That which is claimed is:

1. A container sidewall blank comprising:

a piece of sheet material having a top edge, a bottom edge, a first side edge, and a second side edge;

a first corner edge extending between said top edge and said first side edge, said first corner edge being generally straight through at least a portion of its full length and intersecting said top edge at a first included obtuse angle and intersecting said first side edge at a second included obtuse angle; and a second corner edge extending between said top edge and said second side edge, said second corner edge comprising a first convex arcuate edge portion tangentially intersecting said top edge, and a first additional edge portion extending from said first convex arcuate edge portion and intersecting said second side edge at an angle in the range from about 45 degrees to about 135 degrees.

2. A container sidewall blank in accordance with claim 1 characterized further to include:

a third corner edge extending between said bottom edge and said first side edge, said third corner edge comprising a second convex arcuate edge portion, a second additional edge portion extending from said second convex arcuate edge portion and intersecting said bottom edge at an angle in the range from about 45 degrees to about 135 degrees, and a third additional edge portion extending from said second convex arcuate edge portion and intersecting said first side edge at an angle in the range from about 45 degrees to about 135 degrees; and a fourth corner edge extending between said bottom edge and said second side edge, said fourth corner edge comprising a fourth additional edge portion intersecting said bottom edge at an angle in the range from about 45 degrees to about 135 degrees and a generally straight edge portion having first and second ends and extending between said fourth additional edge portion and second side edge, the first end of said generally straight edge portion intersecting said fourth additional edge portion and the second end of said generally straight edge portion intersecting said second side edge at a third included obtuse angle.

3. A container sidewall blank in accordance with claim 2 wherein said first included obtuse angle is in the range from about 114 degrees to about 144 degrees, said second included obtuse angle is in the range from about 126 degrees to about 156 degrees, and said third included obtuse angle is in the range from about 110 degrees to about 140 degrees.

4. A container sidewall blank in accordance with claim 1 wherein said first included obtuse angle is in the range from about 114 degrees to about 144 degrees, and said second included obtuse angle is in the range from about 126 degrees to about 156 degrees.

5. A container sidewall blank comprising:

a generally rectangularly shaped piece of relatively flexible sheet material having a top edge, a bottom edge, a first side edge, and a second side edge;

a first corner edge extending between said top edge and said first side edge, said first corner edge being generally straight through at least a substantial portion of its full length and intersecting said top edge at a first included obtuse angle and intersecting said first side edge at a second included obtuse angle;

a second corner edge extending between said top edge and said second side edge, said second corner edge comprising a first convex arcuate edge portion of substantially constant radius tangentially intersecting said top edge, and a first concave arcuate edge portion of substantially constant radius intersecting said second side edge at an angle of approximately 90 degrees, and said first convex arcuate edge portion and said first concave arcuate edge portion intersecting in mutual substantially tangential relation;

a third corner edge extending between said bottom edge and said first side edge, said third corner edge comprising a second concave arcuate edge portion of substantially constant radius intersecting said bottom edge at an angle of approximately 90 degrees, a third concave arcuate edge portion of substantially constant radius intersecting said first side edge at an angle of approximately 90 degrees, and a second convex arcuate edge portion of substantially constant radius extending between said second concave arcuate edge portion and said third concave arcuate edge portion and intersecting each of said second and third concave arcuate edge portions in mutual substantially tangential relation; and a fourth corner edge extending between said bottom edge and said second side edge, said fourth corner edge comprising a fourth concave arcuate edge portion of substantially constant radius intersecting said bottom edge at an angle of approximately 90 degrees and a generally straight edge portion having first and second ends and extending between said fourth concave arcuate edge portion and said second side edge, the first end of said generally straight edge portion tangentially intersecting said fourth concave arcuate edge portion and the second end of said generally straight edge portion intersecting said second side edge at a third included obtuse angle.

6. A sidewall blank in accordance with claim 5 wherein the radii of said first, second, third and fourth concave arcuate edge portions are substantially equal to each other, and the radii of said first and second convex arcuate edge portions are substantially equal to each other.

7. A sidewall blank in accordance with claim 6 wherein the length of each of the radii of said first and second convex edge portions is about four times the length of each of the radii of said first, second, third and fourth concave arcuate edge portions.

8. A sidewall in accordance with claim 5 wherein said first included obtuse angle is in the range from about 114 degrees to about 144 degrees, said second included obtuse angle is in the range from about 126 degrees to about 156 degrees, and said third included obtuse angle is in the range from about 110 degrees to about 140 degrees.

9. A sidewall in accordance with claim 1 or claim 5 wherein said sheet material has a thickness in the range from about 0.012 inch (0.30 mm) to about 0.022 inch (0.56 mm).

10. A sidewall in accordance with claim 1 or claim 5 wherein said sheet material comprises a sheet of paperboard.

11. A sidewall in accordance with claim 1 or claim 5 wherein said sheet material comprises a sheet of paperboard with at least one side of said sheet of paperboard being coated with a film of thermoplastic material.

12. A sidewall in accordance with claim 1 or claim 5 wherein said sheet material comprises a sheet of paperboard with each side of said sheet of paperboard being coated with a film of thermoplastic material.

13. A sidewall in accordance with claim 5 wherein said flexible sheet material has a thickness, and the radius of each of said first, second, third and fourth concave arcuate edge portions is approximately equal to about 4 times said thickness of said sheet material, and the radius of each of said first and second convex arcuate edge portions is approximately equal to about 15 times said thickness of said sheet material.

14. A sidewall in accordance with claim 5 wherein the radius of each of said first, second, third and fourth concave arcuate edge portions is in the range from about 0.046 inch (1.1 mm) to about 0.079 inch (2.0 mm), and wherein the radius of each of said first and second convex arcuate edge portions is in the range from about 0.218 inch (5.5 mm) to about 0.282 inch (7.2 mm).

15. A tubular container comprising:

a one-piece sidewall in the form of a single piece of sheet material having a top edge, a bottom edge, a first side edge, and a second side edge;

a first corner edge extending between said top edge and said first side edge, said first corner edge being generally straight through at least a portion of its full length and intersecting said top edge at a first included obtuse angle and intersecting said first side edge at a second included obtuse angle; and a second corner edge extending between said top edge and said second side edge, said second corner edge comprising a first convex arcuate edge portion tangentially intersecting said top edge, and a first additional edge portion extending from said first convex arcuate edge portion and intersecting said second side edge at an angle in the range from about 45 to about 135 degrees; said single piece of sheet material being formed in a convolute tubular shape with said second side edge overlapping said first side edge thereby defining a convolute sidewall having a substantially circular container top and a substantially circular container bottom with said second side edge on the outside of said convolute sidewall and with said first side edge on the inside of said convolute sidewall;

means sealingly securing the adjacent overlapping surfaces of said single piece of sheet material adjacent said first and second side edges together;

a substantially circular bottom member disposed adjacent said substantially circular container bottom;

means sealingly securing said substantially circular container bottom to said substantially circular bottom member so as to close said substantially circular container bottom; and said substantially circular container top being characterized by an outwardly rolled top rim formed thereon adjacent said top edge thereof.

16. A tubular container in accordance with claim 15 wherein said first included obtuse angle is in the range from about 114 degrees to about 144 degrees, and said second included obtuse angle is in the range from about 126 degrees to about 156 degrees.

17. A tubular container in accordance with claim 15 wherein said single piece of sheet material is characterized further to include:

a third corner edge extending between said bottom edge and said first side edge, said third corner edge comprising a second convex arcuate edge portion, a second additional edge portion extending from said second convex arcuate edge portion and intersecting said bottom edge at an angle in the range from about 45 degrees to about 135 degrees and a third additional edge portion extending from said second convex arcuate edge portion and intersecting said first side edge at an angle in the range from about 45 degrees to about 135 degrees; and a fourth corner edge extending between said bottom edge and said second side edge, said fourth corner edge comprising a fourth additional edge portion intersecting said bottom edge at an angle in the range from about 45 degrees to about 135 degrees and a generally straight edge portion having first and second ends and extending between said fourth additional edge portion and said second side edge, the first end of said generally straight edge portion intersecting said fourth additional edge portion and the second end of said generally straight edge portion intersecting said second side edge at a third included obtuse angle.

18. A tubular container in accordance with claim 17 wherein said first included obtuse angle is in the range from about 114 degrees to about 144 degrees, said second included obtuse angle is in the range from about 126 degrees to about 156 degrees, and said third included obtuse angle is in the range from about 110 degrees to about 140 degrees.

19. A tubular container in accordance with claim 16 or claim 18 wherein said rolled top rim has a bead radius in the range from about 0.3 inch (0.76 mm) to about 0.1 inch (2.6 mm) and said second side edge overlaps said first side edge a distance in the range from about 0.25 inch (6.3 mm) to about 0.5 inch (12.7 mm).

20. A tubular container in accordance with claim 19 wherein said single piece of sheet material has a thickness in the range from about 0.012 inch (0.30 mm) to about 0.022 inch (0.56 mm).

21. A tubular container in accordance with claim 20 wherein said substantially circular bottom member includes a depending annular flange about the periphery thereof, and said substantially circular container bottom is rolled inwardly around said depending annular flange and is secured thereto by said means mutually sealing said substantially circular container bottom and said substantially circular bottom member.

22. A tubular container in accordance with claim 21 wherein each of said first, second, third and fourth additional edge portions is defined by a corresponding concave arcuate edge portion, and wherein the radius of each of said concave arcuate edge portions is in the range from about 0.46 inch (1.1 mm) to about 0.79 inch (2.0 mm), and wherein the radius of each of said first and second convex arcuate edge portions is in the range from about 0.218 inch (5.5 mm) to about 0.282 inch (7.2 mm).

23. A method of forming a plurality of container sidewall blanks from sheet material, each said container sidewall blank having a top edge; a bottom edge; a first said edge; a second side edge; a first corner edge extending between said top edge and said first side edge, said first corner edge being generally straight through at least a portion of its full length and intersecting said top edge at a first included obtuse angle and intersecting said first side edge at a second included obtuse angle; a third corner edge extending between said top edge and said second side edge, said second corner edge comprising a first convex arcuate edge portion tangentially intersecting said top edge, and a first additional edge portion extending from said first convex arcuate edge portion and intersecting said second side edge at an angle in the range from about 45 degrees to about 135 degrees; a third corner edge extending between said bottom edge and said first side edge, said third corner edge comprising a second convex arcuate edge portion, a second additional edge portion extending said second convex arcuate edge portion and intersecting said bottom edge at an angle in the range from about 45 degrees to about 135 degrees, and a third additional edge portion extending from said second convex arcuate edge portion and intersecting said first side edge at an angle in the range from about 45 degrees to about 135 degrees; and a fourth corner edge extending between said bottom edge and said second side edge, said fourth corner edge comprising a fourth additional edge portion intersecting said bottom edge at an angle in the range from about 45 degrees to about 135 degrees and a generally straight edge portion having first and second ends and extending between said fourth additional edge portion and said second side edge, the first end of said generally straight edge portion intersecting said fourth additional edge portion and the second end of said generally straight edge portion intersecting said second side edge at a third included obtuse angle, said method comprising:

cutting said plurality of container sidewall blanks from said sheet material with the bottom edge of a first one of said container sidewall blanks juxtaposed along the top edge of a second one of said container sidewall blanks, with the first side edge of said second one of said container sidewall blanks juxtaposed along the second side edge of a third one of said container sidewall blanks, with the top edge of said third one of said container sidewall blanks juxtaposed along the bottom edge of a fourth one of said container sidewall blanks, with the second side edge of said fourth one of said container sidewall blanks juxtaposed along the first side edge of said first one of said container sidewall blanks, and with the third corner edge of said first one of said container sidewall blanks, the first corner edge of said second one of said container sidewall blanks, the second corner edge of said third one of said container sidewall blanks, and the fourth corner edge of said fourth one of said container sidewall blanks mutually defining a cut-out portion of said sheet material devoid of any point having an included angle less than about 90 degrees.

24. A blanking die pattern for cutting a plurality of container sidewall blanks from sheet material, each said container sidewall blank having a top edge; a bottom edge; a first side edge; a second side edge; a first corner edge extending between said top edge and said first side edge, said first corner edge being generally straight through at least a portion of its full length and intersecting said top edge at a first included obtuse angle and intersecting said first side edge at a second included obtuse angle; a second corner edge extending between said top edge and said second side edge, said second corner edge comprising a first convex arcuate edge portion tangentially intersecting said top edge, and a first additional edge portion extending from said first convex arcuate edge portion and intersecting said second side edge at an angle in the range from about 45 degrees to about 135 degrees; a third corner edge extending between said bottom edge and said first side edge, said third corner edge comprising a second convex arcuate edge portion, a second additional edge portion extending from said second convex arcuate edge portion and intersecting said bottom edge at an angle in the range from about 45 degrees to about 135 degrees, and a third additional edge portion extending from said second convex arcuate edge portion and intersecting said first side edge at an angle in the range from about 45 degrees to about 135 degrees; and a fourth corner edge extending bewteen said bottom edge and said second side edge, said fourth corner edge comprising a fourth additional edge portion intersecting said bottom edge at an angle in the range from about 45 degrees to about 135 degrees and a generally straight edge portion having first and second ends and extending between said fourth additional edge portion and said second side edge, the first end of said generally straight edge portion intersecting said fourth additional edge portion and the second end of said generally straight edge portion intersecting said second side edge at a third included obtuse angle, said blanking pattern comprising:

first, second, third and fourth ones of said container sidewall blanks arranged with the bottom edge of said first one of said container sidewall blanks juxtaposed along the top edge of said second one of said container sidewall blanks, with the first side edge of said second one of said container sidewall blanks juxtaposed along the second side edge of said third one of said container sidewall blanks, with the top edge of said third one of said container sidewall blanks juxtaposed along the bottom edge of said fourth one of said container sidewall blanks, with the second side edge of said fourth one of said container sidewall blanks juxtaposed along the first side edge of said first one of said container sidewall blanks, and with the third corner edge of said first one of said container sidewall blanks, the first corner edge of said second one of said container sidewall blanks, the second corner edge of said third one of said container sidewall blanks, and the fourth corner edge of said fourth one of said container sidewall blanks mutually defining a cut-out portion of said sheet material devoid of any point having an included angle less than about 90 degrees.

25. A blanking die pattern in accordance with claim 24 wherein said first, second, third and fourth additional edge portions are characterized further as being concave arcuate edge portions having substantially equal radii of curvature.

26. A blanking die pattern in accordance with claim 25 wherein said first and second convex arcuate edge portions have substantially equal radii of curvature, the length of each radius of curvature of said first and second convex arcuate edge portions being about four times the length of each of the radii of curvature of said first, second, third and fourth concave arcuate edge portions.

27. A blanking die pattern in accordance with claim 26 wherein said first included obtuse angle is in the range from about 114 degrees to about 144 degrees, said second included obtuse angle is in the range from about 126 degrees to about 156 degrees, and said third included obtuse angle is in the range from about 110 degrees to about 140 degrees.

28. An article of manufacture comprising:

a piece of sheet material;

at least four container sidewall blanks formed in said piece of sheet material, each said container sidewall blank having a top edge; a bottom edge; a first side edge; a second side edge; a first corner edge extending between said top edge and said first side edge, said first corner edge being generally straight through at least a portion of its full length and intersecting said top edge at a first included obtuse angle and intersecting said first side edge at a second included obtuse angle; a second corner edge extending between said top edge and said second side edge, said second corner edge comprising a first convex arcuate edge portion tangentially intersecting said top edge and a first additional edge portion extending from said first convex arcuate edge portion and intersecting said second side edge at an angle in the range from about 45 degrees to about 135 degrees; a third corner edge extending between said bottom edge and said first side edge, said third corner edge comprising a second convex arcuate edge portion, a second additional edge portion extending from said second convex arcuate edge portion and intersecting said bottom edge at an angle in the range from about 45 degrees to about 135 degrees, and a third additional edge portion extending from said second convex arcuate edge portion and intersecting said first said edge at an angle in the range from about 45 degrees to about 135 degrees; and a fourth corner edge extending between said bottom edge and said second side edge, said fourth corner edge comprising a fourth additional edge portion intersecting said bottom edge at an angle in the range from about 45 degrees to about 135 degrees and a generally straight edge portion having first and second ends and extending between said fourth additional edge portion and said second side edge, the first end of said generally straight edge portion intersecting said fourth additional edge portion and the second end of said generally straight edge portion intersecting said second side edge at a third included obtuse angle;

said container sidewall blanks being arranged on said piece of sheet material with the bottom edge of a first one of said container sidewall blanks juxtaposed along the top edge of a second one of said container sidewall blanks, with the first side edge of said second one of said container sidewall blanks juxtaposed along the second side edge of a third one of said container sidewall blanks, with the top edge of said third one of said container sidewall blanks juxtaposed along the bottom edge of a fourth one of said container sidewall blanks, with the second side edge of said fourth one of said container sidewall blanks juxtaposed along the first side edge of said first one of said container sidewall blanks; and the third corner edge of said first one of said container sidewall blanks, the first corner edge of said second one of said container sidewall blanks, the second corner edge of said third one of said container sidewall blanks, and the fourth corner edge of said fourth one of said container sidewall blanks mutually defining a cut-out portion in said sheet material devoid of any point having an included angle less than about 90 degrees.

29. An article of manufacture in accordance with claim 28 wherein said first, second, third and fourth additional edge portions are characterized further as being concave arcuate edge portions.

30. An article of manufacture in accordance with claim 29 wherein said concave arcuate edge portions have substantially equal radii of curvature, said first and second convex arcuate edge portions have substantially equal radii of curvature, and the length of each radius of curvature of said first and second convex arcuate edge portions is about four times the length of each radius of curvature of said concave arcuate edge portions.

31. An article of manufacture in accordance with claim 30 wherein said first included obtuse angle is in the range from about 114 degrees to about 144 degrees, said second included obtuse angle is in the range from about 126 degrees to about 156 degrees, and said third included obtuse angle is in the range from about 110 degrees to about 140 degrees.

32. A container sidewall blank for forming a convolute tubular container sidewall having a substantially circular container top and a substantially circular container bottom and having an outwardly rolled top rim formed thereon around said substantially circular container top with said outwardly rolled top rim having a bead radius of predetermined length, said container sidewall blank comprising:

a piece of sheet material having a top edge, a bottom edge, a first side edge, and a second side edge;

a first corner edge extending between said top edge and said first side edge, said first corner edge being generally straight through at least a portion of its full length and intersecting said top edge at a first included obtuse angle and intersecting said first side edge at a second included obtuse angle and at a distance approximately five times the length of said bead radius measured vertically downwardly from the horizontal line of said top edge; and a second corner edge extending between said top edge and said second side edge, said second corner edge comprising a first convex arcuate edge portion tangentially intersecting said top edge, and a first additional edge portion extending from said first convex arcuate edge portion and intersecting said second side edge at an angle in the range from about 45 degrees to about 135 degrees and at a distance approximately five times the length of said bead radius measured vertically downwardly from the horizontal line of said top edge.

33. A container sidewall blank in accordance with claim 32 wherein said first included obtuse angle is in the range from about 114 degrees to about 144 degrees, and said second included obtuse angle is in the range from about 126 degrees to about 156 degrees.

34. An improved sidewall blank, having a top edge, a bottom edge, a first side edge, and a second side edge, for forming a convolute tubular container sidewall with a substantially circular container top and an outwardly rolled rim formed along said substantially circular container top, and with the second side edge overlapping the outer surface of said sidewall blank adjacent the first side edge a predetermined overlap distance, said sidewall blank comprising:

a first corner edge extending between said top edge and said first side edge, said first corner edge being generally straight through at least a portion of its full length and intersecting said top edge at a first included obtuse angle and intersecting said first side edge at a second included obtuse angle;

a second corner edge extending between said top edge and said second side edge, said second corner edge comprising a first convex arcuate edge portion tangentially intersecting said top edge, and a first additional edge portion extending from said first convex arcuate edge portion and intersecting said second side edge at an angle in the range from about 45 degrees to about 135 degrees; and said first corner edge intersecting said top edge and said first side edge, and said second corner edge intersecting said top edge and said second side edge at respective points whereby the overlapped portions of said sidewall blank form a substantially smooth portion of said outwardly rolled top rim substantially free of bulges, tears, tails and splits.

35. An improved sidewall blank in accordance with claim 34 characterized further to include:

a third corner edge extending between said bottom edge and said first side edge, said third corner edge comprising a second convex arcuate edge portion, a second additional edge portion extending from said second convex arcuate edge portion and intersecting said bottom edge at an angle in the range from about 45 degrees to about 135 degrees, and a third additional edge portion extending from said second convex arcuate edge portion and intersecting said first side edge at an angle in the range from about 45 degrees to about 135 degrees; and a fourth corner edge extending between said bottom edge and said second side edge, said fourth corner edge comprising a fourth additional edge portion intersecting said bottom edge at an angle in the range from about 45 degrees to about 135 degrees and a generally straight edge portion having first and second ends and extending between said fourth additional edge portion and said second side edge, the first and of said generally straight edge portion intersecting said fourth additional edge portion and the second end of said generally straight edge portion intersecting said second side edge at a third included obtuse angle.

36. A container sidewall blank in accordance with claim 35 wherein:

said first corner edge intersects said top edge at a distance approximately one-half the predetermined overlap length measured horizontally from the vertical line of said first side edge;

said second corner edge intersects said top edge at a distance approximately one-half the predetermined overlap distance measured horizontally from the vertical line of said second side edge;

said third corner edge intersects said bottom edge at a distance approximately one-half the predetermined overlap distance measured horizontally from the vertical line of said first side edge; and said fourth corner edge intersects said bottom edge at a distance approximately one-half the predetermined overlap distance measured horizontally from the vertical line of said second side edge.

37. A container sidewall blank in accordance with claim 36 wherein said first included obtuse angle is in the range from about 114 degrees to about 144 degrees, said second included obtuse angle is in the range from about 126 degrees to about 156 degrees, and said third included obtuse angle is in the range from about 110 degrees to about 140 degrees.

38. A sidewall in accordance with claim 5 wherein said sheet material has a thickness in the range from about 0.012 inch (0.30 mm) to about 0.022 inch (0.56 mm), and wherein the radius of each of said first, second, third and fourth concave arcuate edge portions is in the range from about 0.046 inch (1.1 mm) to about 0.079 inch (2.0 mm), and wherein the radius of each of said first and second convex arcuate edge portions is in the range from about 0.218 inch (5.5 mm) to about 0.282 inch (7.2 mm).

* * * * *

UNITED STATES PATENT AND TRADEMARK OFFICE

CERTIFICATE OF CORRECTION

PATENT NO. : 4,201,328

DATED : May 6, 1980

INVENTOR(S) : George E. MacEwen

It is certified that error appears in the above-identified patent and that said Letters Patent are hereby corrected as shown below:

Column 11, claim 23, line 18, before "edge" change "said" to --- side ---; line 34, after "extending" and before "said" insert --- from ---.

Column 12, claim 24, line 37, after "extending" and before "said" change "bewteen" to --- between ---.

Column 13, claim 28, line 55, after "first" and before "edge" change "said", second occurrence, to --- side ---.

Column 16, claim 35, line 12, after "first" and before "of", change "and" to --- end ---.

Signed and Sealed this

*Seventeenth* Day of *March 1981*

[SEAL]

*Attest:*

RENE D. TEGTMEYER

*Attesting Officer*

*Acting Commissioner of Patents and Trademarks*